US009387499B2

(12) United States Patent
Sun

(10) Patent No.: US 9,387,499 B2
(45) Date of Patent: Jul. 12, 2016

(54) VARIABLE FLOW CONCENTRATION PRODUCT DISPENSER

(71) Applicant: Ming Sun, Doraville, GA (US)

(72) Inventor: Ming Sun, Doraville, GA (US)

(73) Assignee: POPS Technologies LLC, Buffalo, NY (US)

( * ) Notice: Subject to any disclaimer, the term of this patent is extended or adjusted under 35 U.S.C. 154(b) by 0 days.

(21) Appl. No.: 14/544,883

(22) Filed: Mar. 2, 2015

(65) Prior Publication Data

US 2015/0224523 A1 Aug. 13, 2015

Related U.S. Application Data

(62) Division of application No. 13/066,729, filed on Apr. 22, 2011, now Pat. No. 8,998,111.

(51) Int. Cl.

| | |
|---|---|
| ***A62C 5/02*** | (2006.01) |
| ***B05B 7/26*** | (2006.01) |
| ***B05B 7/24*** | (2006.01) |
| ***B05B 1/30*** | (2006.01) |
| ***B05B 7/12*** | (2006.01) |

(52) U.S. Cl.

CPC ..... *B05B 7/2443* (2013.01); *B05B 1/3013* (2013.01); *B05B 7/12* (2013.01)

(58) Field of Classification Search

CPC ..... B05B 1/3013; B05B 7/12; B05B 7/2443; B05B 7/1463

USPC ..... 239/9, 302–304, 310, 318, 344, 353, 239/354, 361, 367, 407, 569, 581.2, 398

See application file for complete search history.

(56) References Cited

U.S. PATENT DOCUMENTS

| | | | | |
|---|---|---|---|---|
| 7,296,761 | B1 * | 11/2007 | Laible | A62C 13/76 137/605 |
| 7,370,813 | B2 * | 5/2008 | Hubmann | B01F 5/0413 239/302 |
| 7,416,140 | B2 * | 8/2008 | Camilleri | B05B 7/2478 222/105 |
| 7,850,095 | B2 * | 12/2010 | Hubmann | B01F 5/0413 239/310 |
| 2004/0112984 | A1 * | 6/2004 | Hubmann | B01F 5/0413 239/302 |
| 2008/0179420 | A1 * | 7/2008 | Hubmann | B01F 5/0413 239/10 |
| 2008/0197214 | A1 * | 8/2008 | Hubmann | B05B 7/2443 239/310 |

* cited by examiner

*Primary Examiner* — Davis Hwu

(74) *Attorney, Agent, or Firm* — Michael McGreal

(57) ABSTRACT

The dispenser comprises an eductor for the drawing of a concentrate fluid from a liquid reservoir container into an input carrier fluid by means of the flow of the other fluid utilizing a venturi effect. In this dispenser the concentration of the concentrate fluid in the input fluid can be varied to differing preset amounts. The dispenser contains an elongated channel having an input for the input fluid and dispensing nozzle at an exit end for dispensing the chemical concentrate fluid in a diluted form. There is a transverse intersecting channel intermediate the input end and the exit end. The transverse intersecting channel has an insert that is moveable in the intersecting channel, apertures of the moveable insert being alignable with apertures in the transverse intersecting channel and the liquid reservoir container holding the concentrate fluid. One aperture is in alignment with the elongated channel and another aperture in alignment with a channel from the liquid reservoir container. The channels from the liquid reservoir container will have a plurality of various sized apertures to provide for the flow of differing amounts of chemical concentrate fluid into the input fluid at a given input fluid flow rate. This results in a product stream of the input fluid diluted to a set concentration. By adjusting the moveable insert in the transverse intersecting channel and/or the input fluid flow rate the concentration of the chemical concentrate in the product fluid is changed.

12 Claims, 6 Drawing Sheets

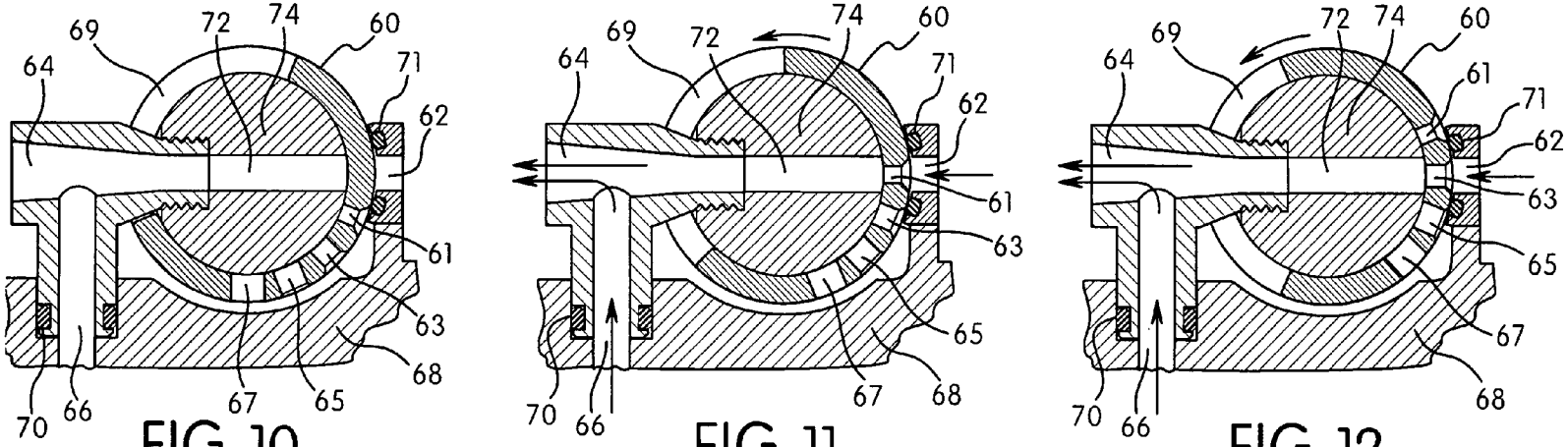
FIG. 10
FIG. 11
FIG. 12
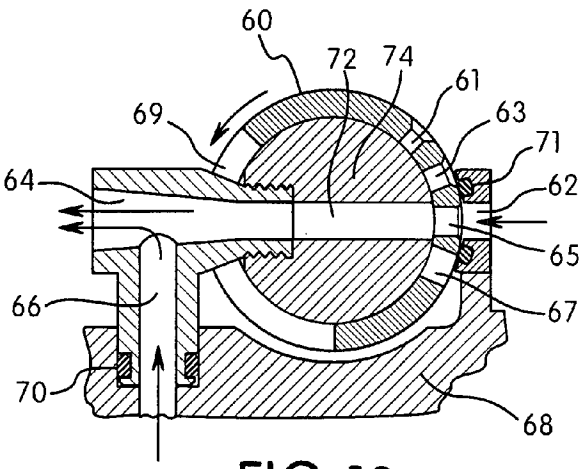
FIG. 13
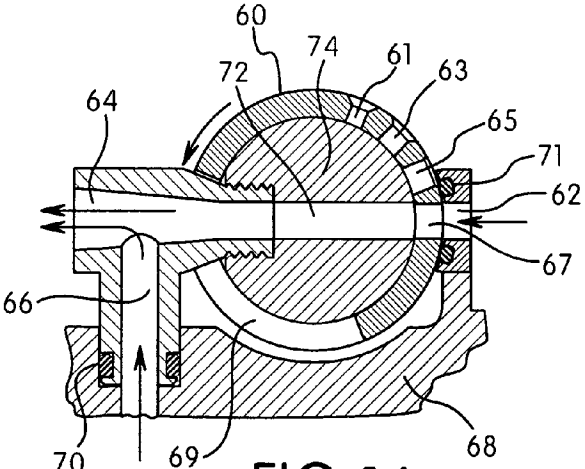
FIG. 14

VARIABLE FLOW CONCENTRATION PRODUCT DISPENSER

This application is a divisional application of U.S. application Ser. No. 13/066,729 filed Apr. 22, 2011, now U.S. Pat. No. 8,998,111, which is a continuation-in-part of application Ser. No. 61/465,056 filed Mar. 14, 2011, both of which are incorporated herein in their entirety.

This invention relates to dispensers for diluted liquid products where the dispenser can dispense the product in a plurality of different concentrations. More particularly the dispenser comprises an adjustable eductor where a concentrate liquid is drawn into a carrier input fluid at different set rates depending on the size of concentrate liquid apertures and the flow rate of the carrier input fluid.

BACKGROUND OF THE INVENTION

Dispensers that utilize educators are well known in the dispensing art. An eductor utilizes a venturi to draw a concentrated liquid from a reservoir into a flowing carrier input fluid to form the product that is to be dispensed. Venturi's have been used for many purposes, including in the carburetors of various vehicles for many years. However, the usual eductor has a venturi arrangement that is set at a given aperture size for a given concentration of the liquid product. This decreases the utility of the dispenser and the eductor. It is preferred that the dispenser, and consequently the eductor be adjustable to provide for products of differing concentrations of a concentrate liquid for a given carrier input fluid flow rate. Such eductor systems have a wide area of utilization. One area is in products for the cleaning of surfaces, such as in buildings. These can include the cleaning of restaurant kitchens and dining rooms, hospital facilities, hotel rooms, offices, restrooms and various other areas. The dispenser can be a part of a continuous spray system for the direct cleaning of large spaces or it can be used in combination with individual containers to fill the containers which then are to be used in various other locations. In the former use the dispensers can be used to clean the floors and other surfaces of large food preparation areas. In the latter use the dispenser can be used to provide the diluted composition to refillable containers. The containers then are used to clean various surfaces in restaurants, hospitals, office buildings, schools and similar buildings. In this use the refillable containers can increase the efficiency of the operations by reducing the number of containers that are needed and which would have to be transported and stored until use.

The prior art dispensers include U.S. Pat. No. 7,341,206; U.S. Pat. No. 7,370,813; and U.S. Pat. No. 6,708,901. These patents are directed to eductor dispensers that can vary the concentration of a concentrated chemical in a product stream. The concentrated chemical is a surface cleaning chemical and the product stream is this concentrated chemical in a diluted condition. The diluting substance is water. The eductor dispensers are comprised of a body member having an elongated channel. Within the elongated channel is an eductor that is moveable along the elongated channel. Associated with the eductor in the elongated channel is a valve that is moveable in the elongated channel along with the eductor. This structure provides for a different concentration of the concentrated chemical in the product stream. Located below the body member is a container that contains the concentrated chemical. The eductor functions as a venturi with the flow of the diluent water stream through the elongated channel drawing up the concentrated chemical into the diluent water stream. The now diluted concentrated chemical product exits the eductor dispenser through a nozzle and can be used directly or can be used to fill a plurality of containers. These eductor dispensers require several internal moving parts and exterior members to control these internal moving parts. Each of these exterior control members require seals and the maintenance of these seals.

The present invention is directed to simplifying eductor dispensers. An objective is to decrease the number of moving parts. Another is to decrease the need to control moving parts from the exterior of the eductor dispenser. This decreases the number of seals that are needed and lowers the cost of the eductor dispenser. In the eductor dispenser of the present invention the concentrated chemical can flow through two or more different sized venturi channels into the input fluid stream to give two or more different concentrations of the chemical concentrate in the input fluid and thus in the now diluted chemical product. Then by varying the flow rate of the diluent input fluid, usually water, the concentration of the concentrated chemical in the diluent input fluid can be further adjusted. A higher flow rate of the diluent input fluid through the venturi of the eductor will increase the amount of concentrated chemical drawn up into the diluent input fluid. The diluent input fluid flow rate, and the size of the venturi channel, will determine the concentration of concentrated chemical in the product stream emanating from a nozzle.

BRIEF SUMMARY OF THE INVENTION

The invention comprises a dispenser having an elongated channel with a dispensing nozzle at an exit end and an input for an input fluid at an input end, a transverse intersecting channel intermediate the input end and the exit end, the intersecting channel extending transversely through the elongated channel, the transverse intersecting channel containing a movable insert with a plurality of apertures. A liquid reservoir having at least one liquid reservoir channel with an aperture. The elongated channel adjacent the transverse intersecting channel has a liquid reservoir aperture for communication to a liquid reservoir channel, the liquid reservoir aperture and at least one of the plurality of apertures of the movable insert being alignable. A venturi is in at least one of the elongated channel, the transverse intersecting channel and the movable insert to cause a reduced pressure at the aligned liquid reservoir aperture and the at least one of the plurality of apertures of the movable insert whereby a liquid in the liquid reservoir is drawn up into the intersecting channel and into the input fluid.

The movable insert has a fluid flow aperture in alignment with the elongated channel for the flow of input fluid therethrough.

Each of the plurality of apertures of the movable insert is of a differing size whereby a different amount of liquid is drawn from the reservoir for a given flow of input fluid.

The movable insert is moveable in the transverse intersecting channel to align at least one of the plurality of apertures with a liquid reservoir channel aperture.

There is a valve in the elongated channel to control the flow of input fluid through the elongated channel, the valve being stationary in the elongated channel.

The liquid reservoir is optionally vented into the transverse intersecting channel whereby a gas is flowed into the liquid reservoir to replace liquid drawn from the liquid reservoir or directly to the atmosphere.

There is a valve prior to the input end of the dispenser to control the flow of input fluid from a source.

The plurality of apertures in the movable insert have a diameter of about 0.005 mm to about 0.1 mm and preferably about 0.01 to about 0.05.

The liquid reservoir is one of permanently or removeably attached to the dispenser. The permanent attachment can comprise a locking arrangement on the dispenser and/or on the container closure.

The invention also comprises a method of dispensing a concentrated liquid in a diluted form comprising providing the concentrated liquid in a liquid reservoir, the dispenser having an elongated channel with an input end and an exit end, and connecting the liquid reservoir to the elongated channel of the dispenser through at least one liquid reservoir channel having an aperture. An input fluid is flowed through the elongated channel from the input end to the outlet end. A transverse intersecting channel containing a movable insert intersects the elongated channel intermediate the input end and the exit end, the movable insert having a plurality of apertures. Aligning one of the plurality of apertures of the movable insert with a liquid channel aperture, and flowing input fluid through the elongated channel whereby a given amount of concentrated liquid is drawn from the liquid reservoir and diluted with the input fluid prior to being dispensed from the exit end of the dispenser.

The input fluid is flowed through the elongated channel at differing rates of flow to cause differing amounts of concentrated liquid to be drawn from the liquid reservoir.

An aperture on the movable insert is chosen, the chosen aperture is aligned with a liquid channel aperture, a flow rate for the input fluid is chosen, and the input fluid is flowed from the input end to the exit end of the elongated channel to provide a diluted concentrated chemical product fluid.

The liquid in the liquid reservoir is at a specific concentration and can be a liquid for cleaning surfaces and can contain a detergent.

BRIEF DESCRIPTION OF THE DRAWINGS

FIGS. 10 to 14 are directed to a second embodiment where there is a rotatable insert in the transverse intersecting channel.

DETAILED DESCRIPTION OF THE INVENTION

The invention will be described in more detail in its preferred embodiments with reference to the drawings. Various modifications can be made to the described preferred embodiments but all such modifications will be within the present concepts and thus within the present invention.

Figure 1:
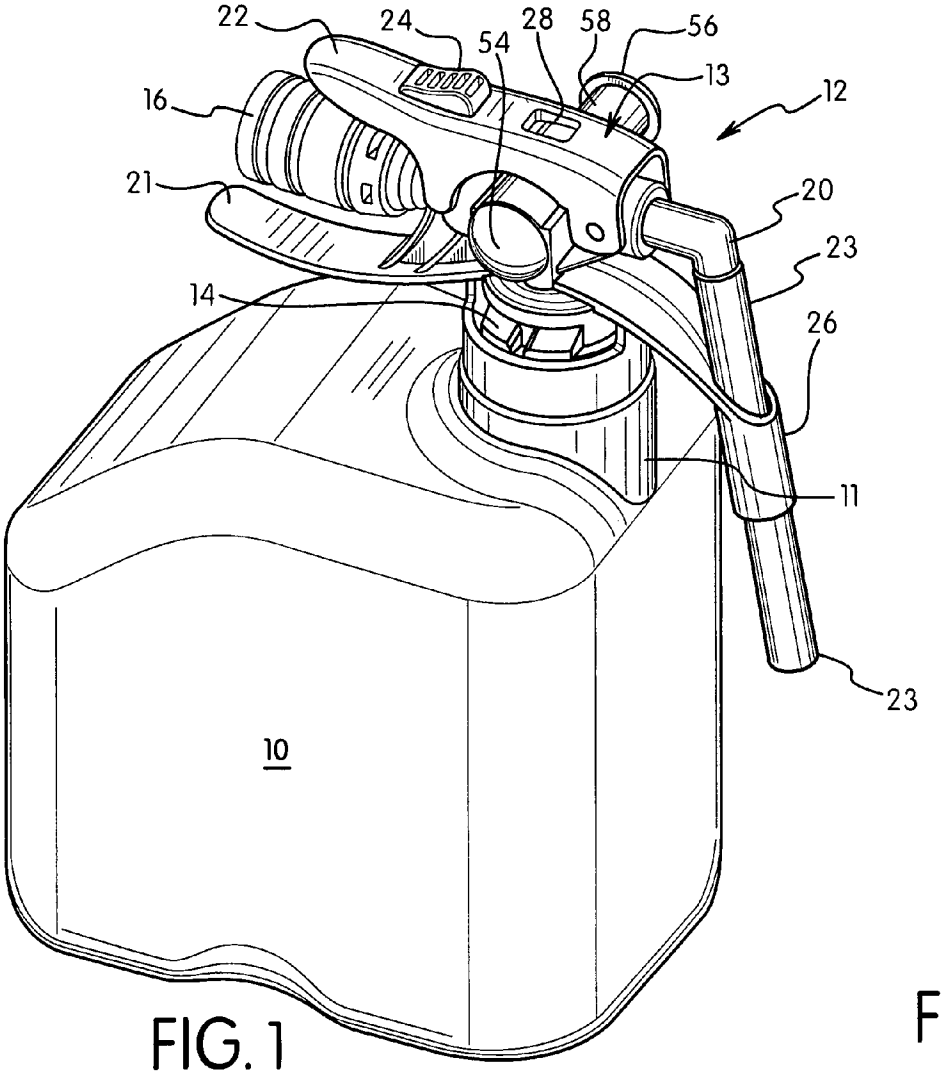
FIG. 1 is a perspective view of the product dispenser attached to a container.

In FIG. 1 the dispenser 12 is attached to liquid reservoir container 10 at the neck 11 of the container. The closure 14, that is an integral part of the dispenser 12, attaches the dispenser to the container 10 as well as being the closure for the liquid reservoir container. The liquid reservoir container 10 can be removeably or permanently attached to the dispenser 12. If removeably attached, the attachment can be via compatible threads. If permanently attached the attachment can be by any known prior art technique such as a prong fitting into a recess. The prong or the recess can be on either the closure attached to the dispenser 12 or on the liquid reservoir container 10. The dispenser 12 has a dispenser body 13 which contains an elongated channel extending from the fluid input to an exit, comprised of a plurality of sections. The dispenser body 13 extends from the diluent input fluid inlet 16 to the outlet nozzle 20 which terminates at the nozzle outlet 23. Brace 26 supports the nozzle 20 and protects it from damage during use of the liquid reservoir container 10 and dispenser 12. There is a two part handle. An upper handle 22 carries diluents input fluid actuator switch 24. There also is a view opening 28 to see within the eductor assembly 50 (see FIG. 2) and the position of a movable insert 58. The movable insert 58 is in the eductor assembly 50 and has a first end 54 and a second end 56. The lower handle 21 functions as the place for a person's fingers to hold the dispenser 12 and in turn also the container 10.

Figure 2:
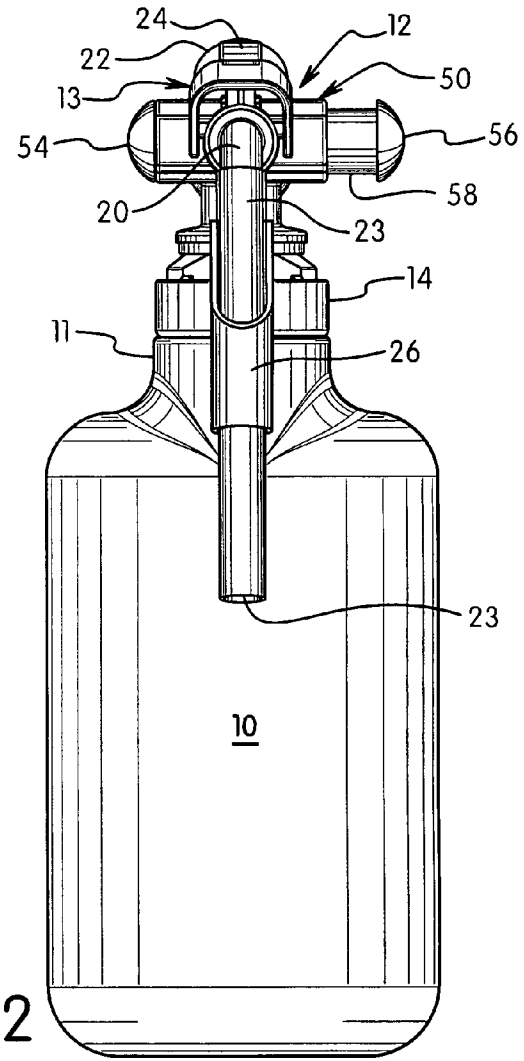
FIG. 2 is a right side elevation view of the product dispenser and container of FIG. 1 with the transverse intersecting channel movable insert being moveable and in a first position.
Figure 3:
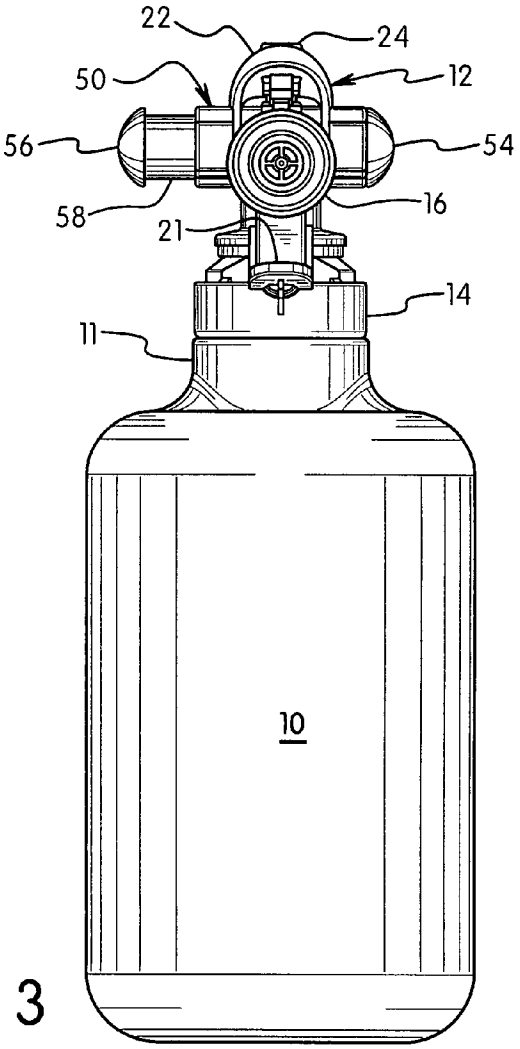
FIG. 3 is a left side elevation view of the product dispenser and container of FIG. 1.

FIG. 2 shows the liquid reservoir container 10 and eductor assembly 50 of dispenser 12 in a front elevation view. The parts are the same as in FIG. 1. Here the movable insert 58 is shown as slideably positioned to the right. FIG. 3 shows the dispenser 12 and liquid reservoir container 10 in a rear elevation view with the moveable insert remaining positioned to the right. In this position a movable insert aperture (see FIG. 5) is in communication with a first channel from the liquid reservoir container 10. The parts numbers are the same in the figures.

Figure 4:
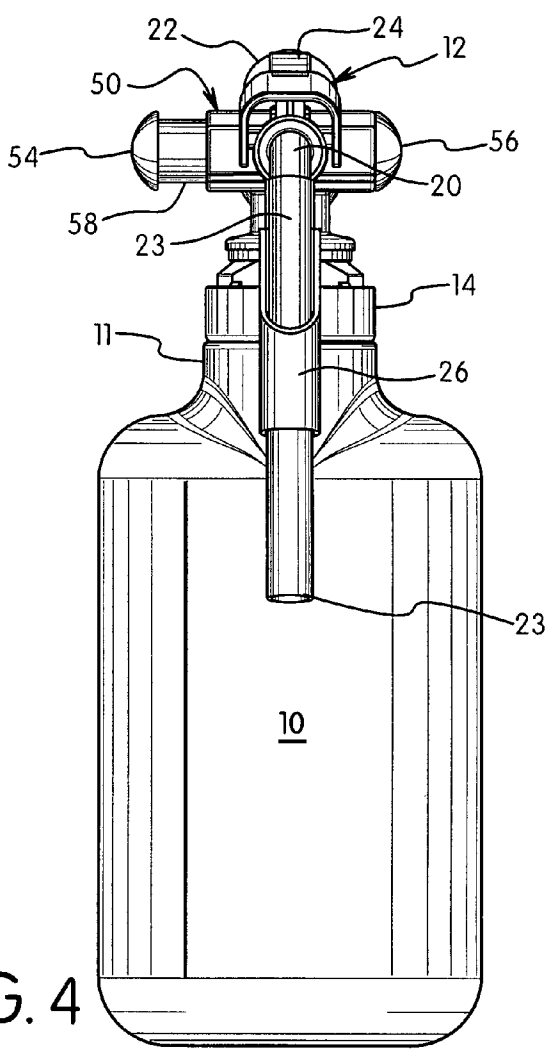
FIG. 4 is a right side elevation view of the product dispenser and container of FIG. 1 with the transverse intersecting channel movable insert in a second position.

FIG. 4 is a view that is the same front elevation view as in that of FIG. 2 except the moveable insert 58 of the eductor assembly 50 has been slideably positioned to the left. This will expose a different channel from the liquid reservoir container 10 to the eductor assembly 50. This different channel from the liquid reservoir container usually will have an outlet diameter different from that of the first channel from the liquid reservoir container to assist in providing a different concentration of the concentrated chemical in the diluent input fluid.

Figure 5:
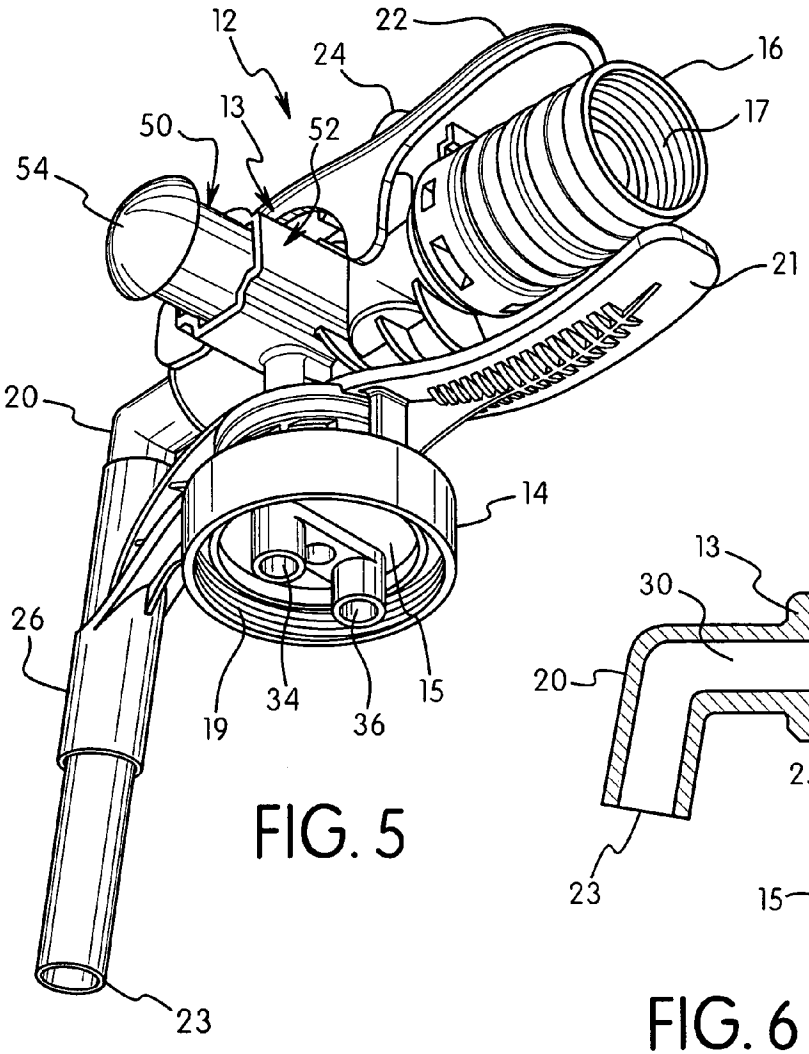
FIG. 5 is an upward perspective view of the product dispenser of FIG. 4 detached from the container and showing the inner structure of the container closure.

FIG. 5 is a bottom perspective view of the dispenser portion of the dispenser 12 of FIG. 3 with the liquid reservoir container 10 removed. The liquid reservoir container closure 14 that is an integral part of the dispenser 12 is more clearly shown in this view. Most of the parts in this view also are shown in FIG. 1 and FIG. 3. In addition shown in this view are the threads 17 in the input fluid inlet 16 for the attachment of a source of a fluid, such as water. Further, there is shown threads 19 on the inner surface of the closure 14 for attachment to the liquid reservoir container 10. These threads 19 mate with companion threads on the neck of container 10. The closure 14 can also contain a gasket for sealing. Closure 14 has inner surface 15 from which extend concentrated chemical channels 34 and 36. These concentrated chemical channels 34 and 36 extend from within liquid reservoir container 10 up into eductor assembly 50 and communicate with apertures in moveable insert 58. These channels can be of the same of differing diameters. If of the same diameters they can have end apertures of different sizes. Housing 52 of eductor assembly 50 provides a channel for the moveable movement of moveable insert 58. This allows the moveable insert 58 to be located over either concentrated chemical channel 34 or channel 36. This will provide differing concentrations of the concentrated chemical in the diluent input fluid depending on the flow rate of the input fluid. Here the concentrated chemical channels 34 and 36 are shown to have varying diameters. If of the same diameters the apertures in the moveable insert 58 can vary to accommodate for the concentrated chemical channels being of the same diameters.

Figure 6:
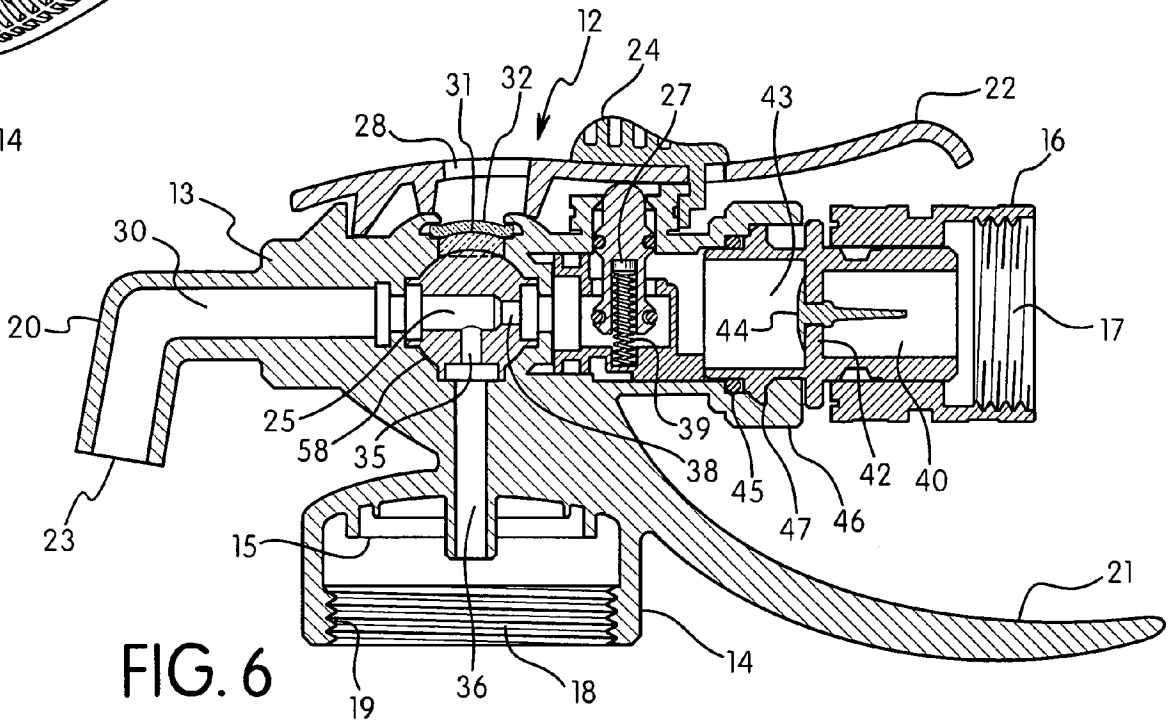
FIG. 6 is a cross-sectional view of a product dispenser of the present invention.

FIG. 6 is cross-section view of the dispenser of FIG. 5 with lower a part of the exit nozzle 20 removed. This is the body 13 of dispenser 12. Shown in this view is liquid inlet 16 with threads 17. This leads into inlet conduit 40 which has stationary backflow preventer valve 44 which is supported by conduit wall 42. This valve 44 prevents product liquid from flowing in a reverse direction and contaminating the source of input fluid. Input fluid that passes through backflow preventer valve 44 enters intermediate conduit 43 and passes to stationary valve 27. This stationary valve 27 is primarily an on/off valve controlled by switch 24 mounted on handle 22. Also shown on the handle is opening 28 revealing fitment 32 holding a transparent window 31 in place. This stationary valve 27 includes a valve spring 39 to bias the valve to a closed position. There can be some variation in the flow and pressure of input fluid via this stationary valve 27 but this is not a primary technique to control the flow of the input fluid. This usually will be accomplished prior to the input fluid entering the body 13 of dispenser 12. The input fluid then enters decreased diameter conduit 25(*b*) of eductor assembly 50 which contains moveable insert 58. Conduit 25(*b*) extends into moveable insert 58 and then to the region 38 adjacent to channel 35(*b*) extending from chemical concentrate channel 36 of the container. Input fluid then enters fluid conduit 38. This flow of input fluid from the narrow diameter conduit 25(*b*) (see FIG. 8) into the fluid conduit 38 causes a reduced pressure adjacent to channel 35(*b*) which causes concentrated chemical in liquid reservoir container 10 to be drawn up through channel 36 and narrowed channel 35(*b*) and into the input fluid in fluid conduit 38. This now mixed input fluid and concentrated chemical enters product conduit 30 and thence into nozzle to exit 23 and subsequent use. There is a companion narrowed channel associated with channel 34 (shown in FIG. 5). These narrowed channels, 35(*b*) associated with channel 36 and that associated with channel 34, have a diameter of about 0.005 mm to about 0.1 mm, and preferably about 0.01 mm to about 0.05 mm. The diameter used will depend on various factors, but primarily on the desired concentration of the chemical concentrate in the product. Also shown in this view is vent valve 41. This valve is shown in more detail in the insert A. Any known commercially available vent valve can be used. In addition vent valves are available from W. L. Gore & Associates in Newark, Del. based on its GORTEX technology. Gortex technology uses specially processed TEFLON materials. The function of this vent valve is to allow air to enter the container to replace liquid that has been withdrawn from the container.

Figure 7:
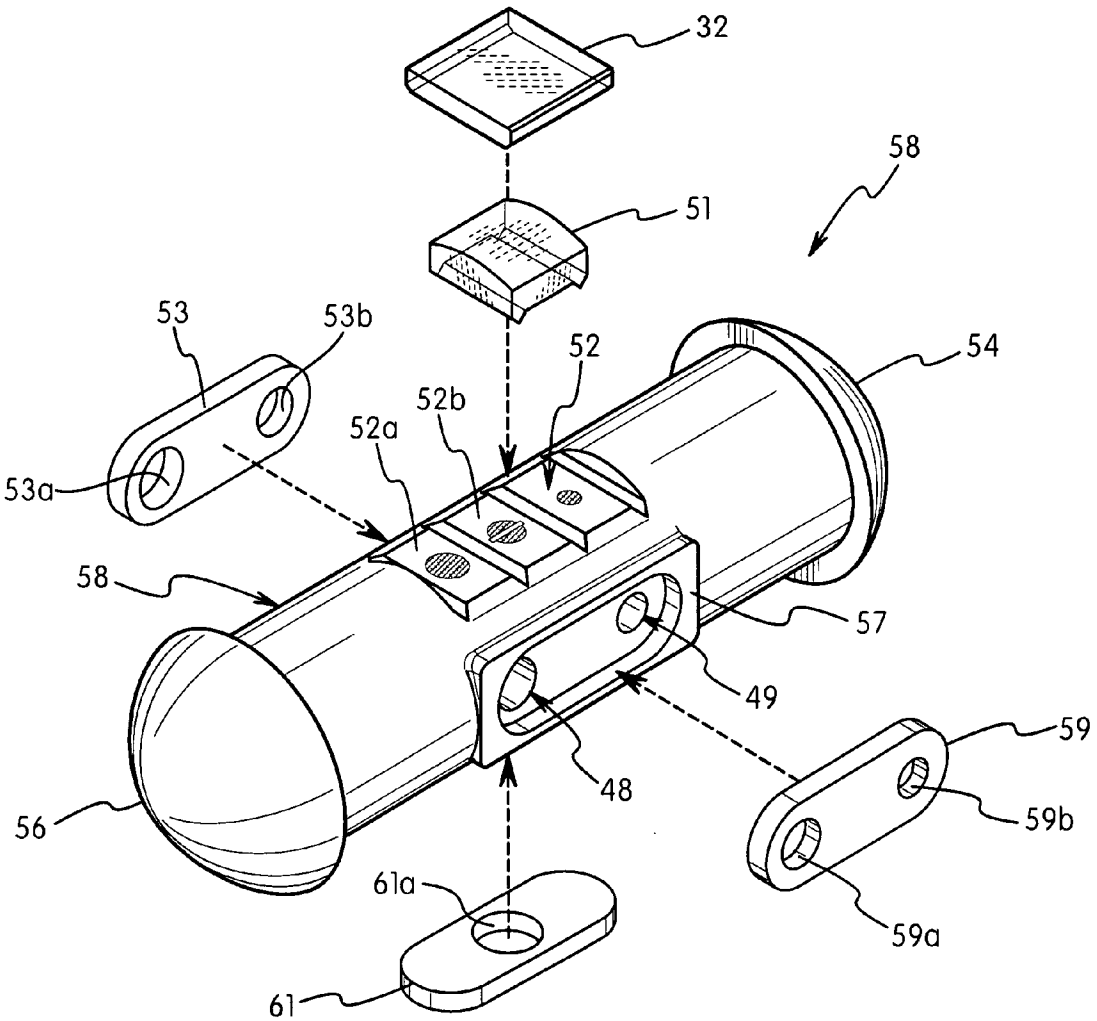
FIG. 7 is a perspective view of the movable insert.

FIG. 7 is a perspective view of the moveable insert 58. This moveable insert 58 is comprised of a center tubular section and enlarged end areas 54 and 56. Shown on an upper surface in this view is indicator area 57. Shown are specific indicator areas 57(*a*) and 57(*b*) which are indicators as to the conduit passage that lies below the indicator. Fluid conduit 25(*a*) lies below area 57(*a*) and fluid conduit 25(*b*) lies below indicator area 57(*b*). Window 31 which is a part of dispenser body 13 is held in place by fixture 32. As the moveable insert is moved there will be visible either the indicator area 57(*a*) to indicate an alignment of fluid conduit 25(*a*) with the passage through the dispenser body 13 or indicator 57(*b*) to indicate alignment of fluid conduit 25(*b*) with the passage through dispenser body 13. Gasket 59 with openings 59(*a*) and 59(*b*) seals the input of diluent input fluid into the moveable insert 58 and gasket 53 with openings 53(*a*) and 53(*b*) seals flow of the diluent input fluid containing concentrated chemical into product channel 30 of the dispenser body 13. This is a product stream. Gasket 61 with opening 61(*a*) seals the flow of concentrated chemical from container channels 34 and 36 into the moveable insert 58.

Figure 8:
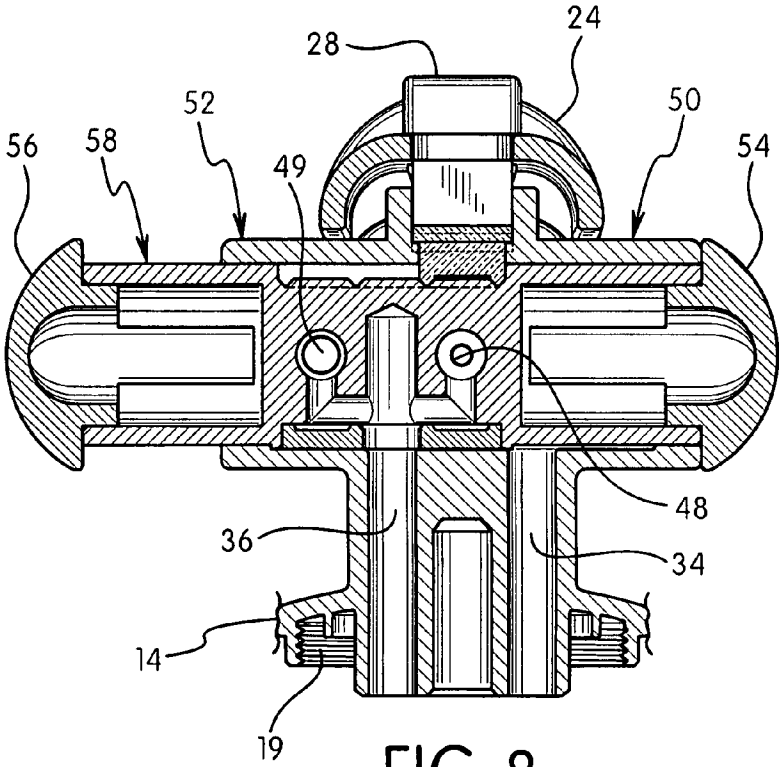
FIG. 8 is a cross-sectional view along line 8-8 of FIG. 6 of the transverse intersecting channel and movable insert drawing concentrated chemical from the liquid reservoir container at a first chemical concentrate flow and a first input fluid flow.

FIG. 8 is a cross-section of dispenser 12 through the moveable insert housing 52. There is shown closure 14 with threads 19. Chemical concentrate channels 34 and 36 flow concentrated chemicals through narrowed channels 35(*b*) and 35(*a*) respectively up into fluid conduits 25(*b*) and 25(*a*) of the venturi of the dispenser body 13. Gasket 61 seals chemical concentrate channels 34 and 36. In this view chemical concentrate channel 36 is flowing the concentrated chemicals through narrowed channel 35(*b*) and up into fluid conduit 25(*b*) of the venturi. There is shown moveable insert housing 52 with moveable insert 58. The housing 52 has a small gap 51 through which air can flow into channel 34 and then into the concentrated chemical container 10 to replace liquid drawn from this container. This moveable insert 58 comprises a center tubular section with enlarged end sections 54 and 56. Also shown is switch 24 and opening 28. In this view concentrated chemical channel 36 is in alignment with the fluid flow channel 25(*b*) of the moveable insert 58. This fluid conduit 25(*b*) has a relatively narrow diameter in comparison to fluid conduit 25(*a*). The diameter of the fluid conduits will control the input fluid to the venturi. In one option the housing 52 has a small gap 51 through which air can flow into channel 34 and then into the concentrated chemical container 10 to replace liquid drawn from the container. Another option is set out in FIG. 6 is to have a vent valve 41 in the closure 14 of the concentrated chemical container. Prior FIG. 6 is a cross-section of the dispenser body 13 incorporating the moveable insert housing 52 of either FIG. 8 or FIG. 9 due to the alignment of concentrate channels 34 and 36. Thus reference is made back to this FIG. 6.

Figure 9:
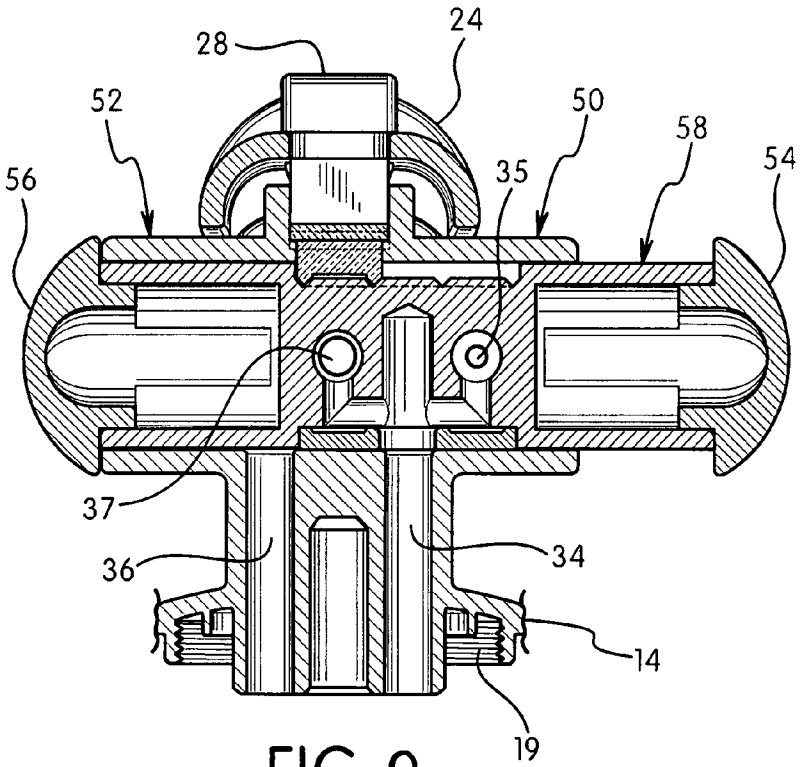
FIG. 9 is a cross-sectional view relkated to FIG. 8 of the transverse intersecting channel and movable insert drawing concentrated chemical from the liquid reservoir container at a second chemical concentrate flow and a second input fluid flow.

FIG. 9 also is a cross-section of dispenser 12 through the moveable insert housing 52. There is shown closure 14 with threads 19. Chemical concentrate channel 34 is shown flowing concentrated chemicals through narrowed channel 35(*a*) up into fluid conduit 25(*a*) of the venturi of the dispenser body 13. Gasket 61 seals chemical concentrate channel 34. As in FIG. 8 there is shown moveable insert housing 52 with moveable insert 58. This moveable insert 58 has a center tubular section with enlarged end sections 54 and 56. Also shown is switch 24 and opening 28. In this view concentrated chemical concentrate channel 34 is in alignment with the fluid conduit 25(*a*) of the moveable insert 58. This fluid conduit 25(*a*) has a relatively large diameter in comparison to fluid conduit 25(*b*). This will allow for a larger volume of the input fluid to pass through the moveable insert 58 to fluid conduit 38. In one option the housing 52 has a small gap 53 through which air can flow into channel 36 and then into the container to replace liquid drawn from the concentrated chemical container 10. Another option is set out in FIG. 6 is to have a vent valve 41 in the closure of the container. As noted prior FIG. 6 is a cross-section of the dispenser body 13 incorporating the moveable insert housing 52 of FIG. 8 or FIG. 9 depending on to the alignment of chemical concentrate channels 34 and 36 and the moveable insert 58.

FIGS. 10 to 14 are directed to another embodiment of the present invention. In this embodiment there is a base support 68 that holds an insert bore 74 which has an insert channel 72. Rotatable insert 60 substantially surrounds insert bore 74. The base support 68 is shown as broken away for greater clarity. There is a diluent input fluid channel 62 which flows input fluid to insert bore channel 72. The input fluid from insert bore channel 72 then passes through expanding channel 64 which creates a venturi effect which in turn draws concentrate chemical through chemical concentrate channel 66 into expanding channel 64 to mix with input fluid. Gasket 70 seals chemical concentrate channel 66 and gasket 71 seals input fluid channel 62. Rotatable insert channel 60 has a plurality of inlets for the input fluid. These are in increasing size inlets 61, 63, 65 and 67. By adjusting the size of the inlet, the flow velocity and volume through input fluid channel 62 can be varied. This will affect the venturi and the amount of chemical concentrate drawn from container 10 into the input fluid and thus into the product stream.

In use the chemical concentrate can be an insecticide, bactericide, herbicide or a cleaning chemical concentrates such as soaps or detergents. The input fluid can be any liquid carrier, either organic or inorganic. However, a preferred low cost input fluid is water.

I claim:

1. A method of dispensing a liquid in a diluted form from an attached vented liquid reservoir having at least two exit channels comprising providing the liquid in a concentrated form in the liquid reservoir, the dispenser having an elongated channel having an input end and an exit end, connecting the liquid reservoir to the elongated channel of the dispenser through at least one of the liquid reservoir exit channels, an input fluid flowed through the elongated channel from the input end to the outlet end, a transverse intersecting channel containing a movable insert intersecting the elongated channel intermediate the input end and the exit end, the movable insert having a plurality of apertures, aligning at least one of the plurality of apertures of the movable insert with an aperture of the at least one liquid reservoir exit channel, and flowing input fluid through the elongated channel whereby a given amount of liquid in a concentrated form is drawn from the liquid reservoir and diluted with the input fluid prior to being dispensed from the exit end, wherein during dispensing the exit channel not being used to flow concentrated liquid to the movable insert is aligned with a passage in the transverse intersecting channel to pass a gas into the passage and into the exit channel not being used to flow concentrated liquid to the movable insert to replace dispensed concentrated liquid.

2. A method as in claim 1 wherein input fluid is flowed through the elongated channel at differing rates of flow to cause differing amounts of liquid in a concentrated form to be drawn from the liquid reservoir.

3. A method as in claim 1 wherein the dilution of the liquid in a concentrated form in the liquid reservoir is determined, an aperture from the plurality of apertures on the movable insert is chosen, the chosen aperture is aligned with the aperture of the at least one the liquid reservoir channel, a flow rate for the input fluid is chosen, and the input fluid is flowed from the input end to the exit end of the elongated channel.

4. A method as in claim 1 wherein the liquid in a concentrated form in the liquid reservoir is at a specific concentration.

5. A method as in claim 1 wherein the liquid in a concentrated form is a liquid for cleaning surfaces.

6. A method as in claim 5 wherein the liquid in a concentrated form for cleaning surfaces contains a detergent.

7. A method as in claim 1 wherein the input fluid contains water.

8. A method as in claim 1 wherein the movable insert is caused to slide in the transverse intersecting channel.

9. A method as in claim 1 wherein the movable insert is caused to rotate in the transverse intersecting channel.

10. A method as in claim 1 wherein the passage connects to the exterior of the dispenser and atmospheric air is flowed into the liquid reservoir to replace dispensed concentrated liquid.

11. A method as in claim 1 wherein the input end is connected to a source of input fluid.

12. A method as in claim 11 wherein the input fluid is water.

* * * * *